United States Patent [19]

Åkerström

[11] Patent Number: 4,569,244

[45] Date of Patent: Feb. 11, 1986

[54] CONTROL LEVER WITH AUTOMATIC RETURN TO ORIGINAL POSITION

[76] Inventor: Åke Åkerström, S-780 45 Björbo, Sweden

[21] Appl. No.: 485,579

[22] PCT Filed: Jul. 8, 1982

[86] PCT No.: PCT/SE82/00239

§ 371 Date: Mar. 22, 1983

§ 102(e) Date: Mar. 22, 1983

[87] PCT Pub. No.: WO83/00398

PCT Pub. Date: Feb. 3, 1983

[30] Foreign Application Priority Data

Jul. 23, 1981 [SE] Sweden ..... 8104509/8

[51] Int. Cl.[4] ..... G05G 9/00

[52] U.S. Cl. ..... 74/471 XY; 74/10.41; 338/128; 200/153 K; 200/6 A

[58] Field of Search ..... 74/471 XY, 10.41; 338/128; 200/153 K, 6 A

[56] References Cited

U.S. PATENT DOCUMENTS

| | | | |
|---|---|---|---|
| 2,481,776 | 9/1949 | Osborn | 338/128 X |
| 3,226,999 | 1/1966 | Allison | 74/10.41 X |
| 3,308,675 | 3/1967 | Jonsson | 338/128 X |
| 3,870,161 | 3/1975 | Cording | 74/471 XY |
| 4,093,953 | 6/1978 | Hammons et al. | 200/6 A X |
| 4,490,710 | 12/1984 | Kopsho, Jr. et al. | 74/471 XY X |

FOREIGN PATENT DOCUMENTS

| | | | |
|---|---|---|---|
| 1540096 | 2/1979 | United Kingdom | 338/128 |

*Primary Examiner*—Rodney H. Bonck
*Assistant Examiner*—Shirish Desai
*Attorney, Agent, or Firm*—Sheridan Neimark; Karl W. Flocks; A. Fred Starobin

[57] ABSTRACT

A device which, when manually operated, will automatically return to an original position wherein a manually-operated control lever rotates at least one shaft having an arm mounted on the end of the shaft, and with a roll at the other end of the arm which abuts against one of two profiled parts when the shaft is rotated by the control lever. The two profiled parts resiliently abut a stop or stops when the arm is in an original or zero position but one profiled part abuts a stop while the other profiled part resiliently abuts the roll on the end of the arm when the shaft is rotated, and the profiled parts have steps thereon which are position markings able to be sensed manually by the control lever by a snap effect.

8 Claims, 4 Drawing Figures

CONTROL LEVER WITH AUTOMATIC RETURN TO ORIGINAL POSITION

BACKGROUND OF THE INVENTION

The invention is related to control units, preferably for a radio control, which, when manually operated, will automatically return to an original position. More particularly, a control lever detects at least one predetermined position of at least one rotatable shaft.

Previously known devices of this type are often very complicated and also very bulky as to their construction and therefore are not conducive for use as a control lever in a miniaturized form are used in industry, especially to control travelling cranes and the like. Such radio control units are normally supported on the belt of the operator fastened around his waist.

SUMMARY OF THE INVENTION

Therefore, it is an object of the invention to provide a device of the type mentioned above, by which the radio control unit is small and compact, and also reliable, robust and easily controlled.

The above-mentioned objects are achieved according to the invention by a device comprising an arm, one end of which is mounted on a shaft so that the arm is rotated about its mounted end upon rotation of the shaft, when the shaft is rotated under the influence of a control lever, and with the arm arranged to abut against one of two adjacent profiled parts which resiliently moved against stop means which stop means are provided in the unactivated original position of the arm, with the profiled parts so formed that when reaching a predetermined position a snap effect can be manually sensed by the control lever.

BRIEF DESCRIPTION OF THE DRAWINGS

The invention is to be described in more detail with reference to the accompanying drawings in which.

DESCRIPTION OF THE PREFERRED EMBODIMENTS

Figure 1:
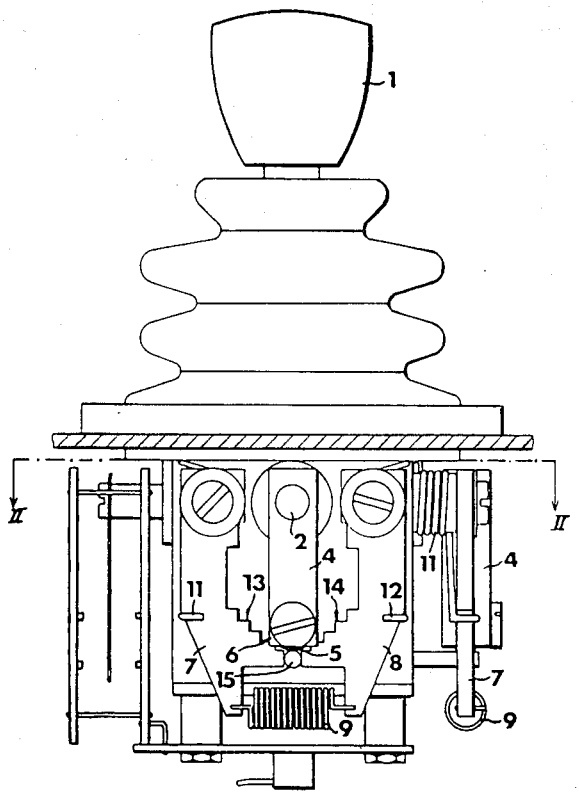
FIG. 1 is a side elevational view of the control lever of the present invention, as for example in a radio control unit.
Figure 2:
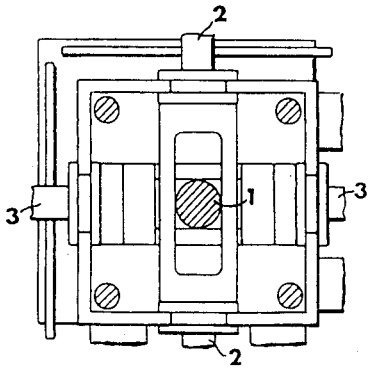
FIG. 2 is a partial section along line II—II of FIG. 1.

With reference to FIG. 1, a control lever 1, preferably for a radio control unit, is shown. As further shown in FIG. 2, two shafts 2, 3 held in a support device, are rotatable in either direction by means of control lever 1. The projecting ends of shafts 2, 3 are provided in the same plane and substantially normal to each other. Each of shafts 2, 3 has an arm 4 fastened to one of its ends. On the opposite end of arm 4, facing toward the direction of the shaft 2 or 3, there is attached a roll 5, which, with the control unit in an original position, the roll 5 abuts against consisting of a helical spring 9 and two torsion springs 11, 12 are so arranged that they press end 6 of arm 4, which has roll 5 attached thereto, and the profiled parts against parts 7, 8 are furnished with steps 13, 14 respectively. Upon rotation of shafts 2, 3 by control lever 1, steps 13, 14 form markings for predetermined positions which can be sensed manually by the control lever 1. The steps 13, 14 are so formed that rotation of shafts 2, 3, can return arm 4 to an original position by means of springs 9, and 11, 13, as shown in FIG. 1.

A stop 15 is provided between profiled parts 7, 8 so that the profiled parts 7, 8 will abut stop 15 when they are in the original position. When one of the profiled parts is activated by roll 5 on arm 4, the other profiled part, not activated by roll 5, abuts stop 15, and in doing so, provides a strain in helical spring 9 and in torsion spring 11 or 12 with the activated profiled part. Due to the use of two different springs being used, a helical spring and torsional springs, double security against spring breakage is obtained and also return of the actuated profile part of the original or O-position is made more secure, when control lever 1 is unloaded.

Figure 3:
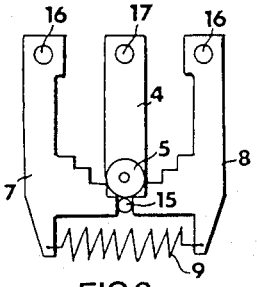
FIG. 3 is a view of a part of the mechanism of FIG. 1 without the use of torsion springs.

In FIG. 3, an embodiment of the device according to the invention is shown in which torsion springs 11 and 12, which have been shown in FIG. 1, are omitted. Parts 7, 8 are rotatable around bearing pins 16. Shafts 2, 3 have ends 17.

Figure 4:
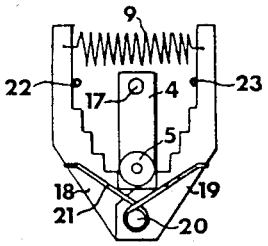
FIG. 4 is a modified embodiment of the part of the mechanism shown in FIG. 3.

In FIG. 4, a modified embodiment of the invention is shown in which the profiled parts 18, 19 are journalled on a pin 20. The upper ends of the profile parts are loaded towards each other by means of a helical spring 9. A torsion spring 21 is placed on the pin 20 and the outer ends of the legs of the torsion spring are situated on the outside of the profiled parts to further load the profiled parts towards each other. Hence, here also a double security against spring breakage is achieved. The spring 9 and 21 are arranged to bring the profiled parts 18, 19 to abut against stops 22 and 23, and moreover to return the arm 4, which is arranged on one of the ends 17 of said shafts 2, 3, to the original position (O-position).

On the free ends of said shafts 2, 3, different types of position indicating switch means can be placed, as e.g. reversing switches, potentiometers or optoelectrical systems.

I claim:

1. A device preferably for use as a radio control unit comprising a manually operated control lever (1);

at least one shaft (2, 3) connected for rotation by said control lever;

an arm (4) having one end fastened on said shaft;

two profiled parts with the other end of said arm, when said arm is rotated by said shaft, abutted against one of said two profiled parts;

stop means against which said profiled parts resiliently abut when said profiled parts are in an original or zero position without abutment by said rotated arm, or which are abutted by one of said parts when said shaft is rotated and the other said part is abutting said arm;

said profiled parts having marking for predetermined positions;

said marking able to be sensed manually by said control lever by a snap effect.

2. Device according to claim 1, characterized in that said marking (13, 14) on each profiled part (7, 8, 18, 19) is so formed, that when said control lever is unactivated, said arm (4) returns automatically to said original position.

3. Device according to any of claim 1, characterized in that said profiled parts (7, 8, 18, 19) consist of elongated members, one end of which being rotatably journalled and the other end of which being loaded towards each other by means of a helical spring (9) arranged between said other ends.

4. Device according to any of claim 1, characterized in that at least one torsion spring (11, 12, 21) is mounted on the profiled parts (7, 8, 18, 19) and is so loaded, that it presses the profiled part (7, 8, 18, 19) in question against said stop means (15, 22, 23).

5. Device according to any of claim 1, characterized in that a roll (5) is journalled on the arm (4) which roll will abut against the profiled parts (7, 8, 18, 19).

6. Device according to any of claim 1, characterized in that said profiled parts (7, 8, 18, 19) are symmetrically arranged around said stop means (15, 22, 23).

7. Device according to claim 1, characterized in that each of said profiled parts (7, 8) are, at one end thereof, pivotally connected at points on each side of said shaft (2, 3); and in that the other end of each of said profile parts will abut, in the unactivated state, against a common stop (15).

8. Device according to any of claim 1, characterized in that said profiled parts (18, 19) are, at one end thereof, journalled in the same point at the end of said arm (4) abutting said parts, and in that each one of said other ends of said profiled parts abuts, in the unactivated state, against a stop (22, 23).

* * * * *